US006260201B1

(12) United States Patent
Rankin

(10) Patent No.: US 6,260,201 B1
(45) Date of Patent: Jul. 17, 2001

(54) PORTABLE COOLING DEVICE

(76) Inventor: Mark J. Rankin, 2216 Quatman Ave., Norwood, OH (US) 45212

( * ) Notice: Subject to any disclaimer, the term of this patent is extended or adjusted under 35 U.S.C. 154(b) by 0 days.

(21) Appl. No.: 09/641,857

(22) Filed: Aug. 18, 2000

(51) Int. Cl.[7] ..... A41B 1/12; A41D 11/00
(52) U.S. Cl. ..... 2/69; 2/81; 2/272; 2/DIG. 3
(58) Field of Search ..... 2/69, 81, 97, 272, 2/DIG. 3

(56) References Cited

U.S. PATENT DOCUMENTS

| | | | | |
|---|---|---|---|---|
| D. 340,542 | | 10/1993 | Marlowe . | |
| 3,116,731 | | 1/1964 | Baxter . | |
| 3,710,395 | * | 1/1973 | Spano et al. | 2/78.1 |
| 4,194,247 | * | 3/1980 | Melander | 2/457 |
| 4,271,833 | * | 6/1981 | Moretti | 128/201.29 |
| 4,390,997 | * | 7/1983 | Hinz et al. | 2/81 |
| 4,451,934 | | 6/1984 | Gioello . | |
| 4,738,119 | * | 4/1988 | Zafred | 607/104 |
| 4,898,160 | | 2/1990 | Brownlee . | |
| 4,914,752 | * | 4/1990 | Hinson et al. | 2/458 |
| 4,997,230 | | 3/1991 | Spitalnick . | |
| 4,998,415 | * | 3/1991 | Larsen | 62/231 |
| 5,014,355 | * | 5/1991 | Vollenweider, II | 2/79 |
| 5,201,365 | * | 4/1993 | Siegel | 165/46 |
| 5,243,706 | * | 9/1993 | Frim et al. | 2/455 |
| 5,263,336 | * | 11/1993 | Kuramarohit | 62/259.3 |
| 5,303,425 | * | 4/1994 | Mele | 2/115 |
| 5,320,164 | * | 6/1994 | Szczesuil et al. | 165/46 |
| 5,438,707 | * | 8/1995 | Horn | 2/457 |
| 5,484,448 | * | 1/1996 | Steale et al. | 607/108 |
| 5,564,124 | * | 10/1996 | Elsherif et al. | 2/69 |
| 5,613,729 | | 3/1997 | Summer, Jr. . | |
| 5,970,519 | * | 10/1999 | Weber | 2/81 |
| 6,134,714 | * | 10/2000 | Uglene | 2/102 |
| 6,178,562 | * | 1/2001 | Elkins | 2/458 |

* cited by examiner

*Primary Examiner*—John J. Calvert
*Assistant Examiner*—Robert H. Muromoto, Jr.

(57) ABSTRACT

A portable cooling device for presenting air across the body of a wearer of the device. The portable cooling device includes a shirt portion. The shirt portion comprises a front panel and a back panel securely coupled together. The shirt portion has a neck opening and a pair of sleeves. Each of the panels has an inner and outer surface. A cooling system includes a plurality of tubular members, each of which is elongate and has a first end and a second end. Each of the tubular members is securely attached to the inner surface of the shirt portion. Each of the tubular members has a peripheral wall has a plurality of openings therein. A connector tube has a first end and a second end. The connector tube is securely attached to the inner surface of the vest member. Each of the first and second ends of the tubular members is fluidly coupled to the connector tube. A supply tube supplies air to the tubular members. The supply tube has a first end and a second end. The first end is fluidly coupled to one of the tubular members. An air delivery means delivers air to the supply tube.

7 Claims, 4 Drawing Sheets

10
12
14
16
18
20
22
24
26
28
30
32
34
40
42
44
48
50
52

4
52
56
58
60

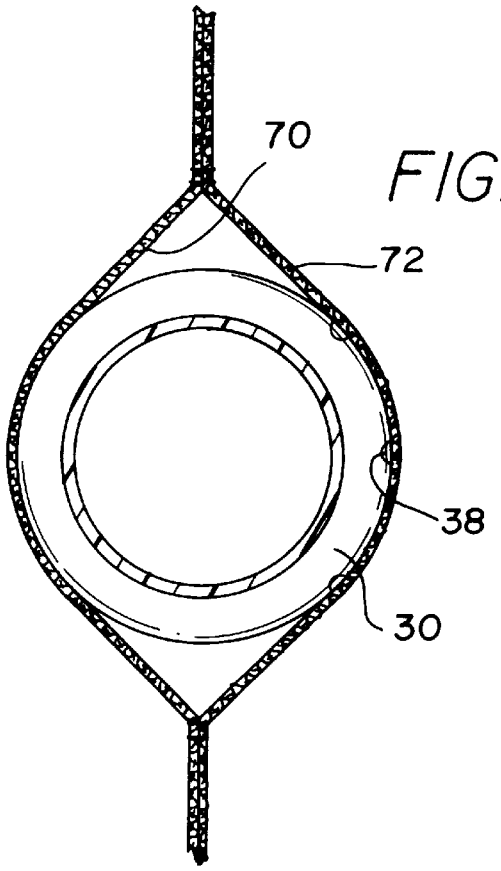
FIG.5
FIG.6
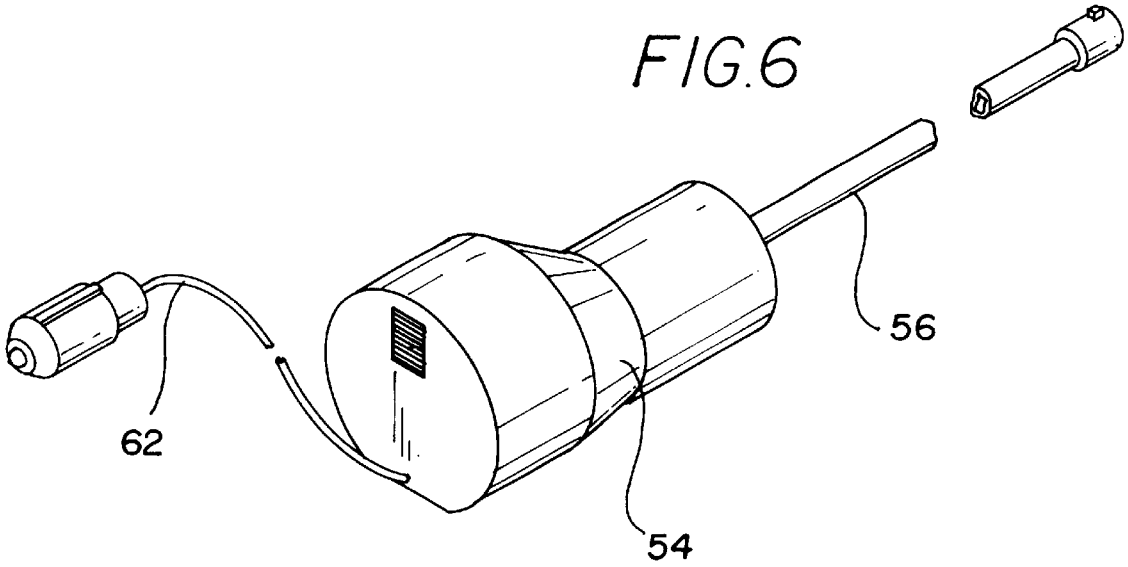

PORTABLE COOLING DEVICE

BACKGROUND OF THE INVENTION

1. Field of the Invention

The present invention relates to cooling devices and more particularly pertains to a new portable cooling device for presenting air across the body of a wearer of the device.

2. Description of the Prior Art

The use of cooling devices is known in the prior art. More specifically, cooling devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,451,934; U.S. Pat. No. 4,997,230; U.S. Pat. No. 5,613,729; U.S. Pat. No. 4,898,160; U.S. Pat. No. 3,116,731; and U.S. Des. Pat. No. 340.542.

While these devices fulfill their respective, particular objectives and requirements, the aforementioned patents do not disclose a new portable cooling device. The inventive device includes a shirt portion. The shirt portion comprises a front panel and a back panel securely coupled together. The shirt portion has a neck opening and a pair of sleeves. Each of the panels has an inner and outer surface. A cooling system includes a plurality of tubular members, each of which is elongate and has a first end and a second end. Each of the tubular members is securely attached to the inner surface of the shirt portion. Each of the tubular members has a peripheral wall has a plurality of openings therein. A connector tube has a first end and a second end. The connector tube is securely attached to the inner surface of the vest member. Each of the first and second ends of the tubular members is fluidly coupled to the connector tube. A supply tube supplies air to the tubular members. The supply tube has a first end and a second end. The first end is fluidly coupled to one of the tubular members. An air delivery means delivers air to the supply tube.

In these respects, the portable cooling device according to the present invention substantially departs from the conventional concepts and designs of the prior art, and in so doing provides an apparatus primarily developed for the purpose of presenting air across the body of a wearer of the device.

SUMMARY OF THE INVENTION

In view of the foregoing disadvantages inherent in the known types of cooling devices now present in the prior art, the present invention provides a new portable cooling device construction wherein the same can be utilized for presenting air across the body of a wearer of the device.

The general purpose of the present invention, which will be described subsequently in greater detail, is to provide a new portable cooling device apparatus and method which has many of the advantages of the cooling devices mentioned heretofore and many novel features that result in a new portable cooling device which is not anticipated, rendered obvious, suggested, or even implied by any of the prior art cooling devices, either alone or in any combination thereof.

To attain this, the present invention generally comprises a shirt portion. The shirt portion comprises a front panel and a back panel securely coupled together. The shirt portion has a neck opening and a pair of sleeves. Each of the panels has an inner and outer surface. A cooling system includes a plurality of tubular members, each of which is elongate and has a first end and a second end. Each of the tubular members is securely attached to the inner surface of the shirt portion. Each of the tubular members has a peripheral wall has a plurality of openings therein. A connector tube has a first end and a second end. The connector tube is securely attached to the inner surface of the vest member. Each of the first and second ends of the tubular members is fluidly coupled to the connector tube. A supply tube supplies air to the tubular members. The supply tube has a first end and a second end. The first end is fluidly coupled to one of the tubular members. An air delivery means delivers air to the supply tube.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawing's. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new portable cooling device apparatus and method which has many of the advantages of the cooling devices mentioned heretofore and many novel features that result in a new portable cooling device which is not anticipated, rendered obvious, suggested, or even implied by any of the prior art cooling devices, either alone or in any combination thereof.

It is another object of the present invention to provide a new portable cooling device which may be easily and efficiently manufactured and marketed.

It is a further object of the present invention to provide a new portable cooling device which is of a durable and reliable construction.

An even further object of the present invention is to provide a new portable cooling device which is susceptible of a low cost of manufacture with regard to both materials and labor, and which accordingly is then susceptible of low prices of sale to the consuming public, thereby making such portable cooling device economically available to the buying public.

Still yet another object of the present invention is to provide a new portable cooling device which provides in the apparatuses and methods of the priori art some of the advantages thereof, while simultaneously overcoming some of the disadvantages normally associated therewith.

Still another object of the present invention is to provide a new portable cooling device for presenting air across the body of a wearer of the device.

Yet another object of the present invention is to provide a new portable cooling device which includes a shirt portion. The shirt portion comprises a front panel and a back panel securely coupled together. The shirt portion has a neck opening and a pair of sleeves. Each of the panels has an inner and outer surface. A cooling system includes a plurality of tubular members, each of which is elongate and has a first end and a second end. Each of the tubular members is securely attached to the inner surface of the shirt portion. Each of the tubular members has a peripheral wall has a plurality of openings therein. A connector tube has a first end and a second end. The connector tube is securely attached to the inner surface of the vest member. Each of the first and second ends of the tubular members is fluidly coupled to the connector tube. A supply tube supplies air to the tubular members. The supply tube has a first end and a second end. The first end is fluidly coupled to one of the tubular members. An air delivery means delivers air to the supply tube.

Still yet another object of the present invention is to provide a new portable cooling device that may be easily worn under other clothes to provide air flow against the skin to cool the body of the wearer.

Even still another object of the present invention is to provide a new portable cooling device that may be coupled to the vent of a car air conditioner.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a schematic cross-sectional view taken along line 5—5 of the present invention.

FIG. 6 is a schematic perspective view of the air pump of the present invention.

DESCRIPTION OF THE PREFERRED EMBODIMENT

Figure 1:
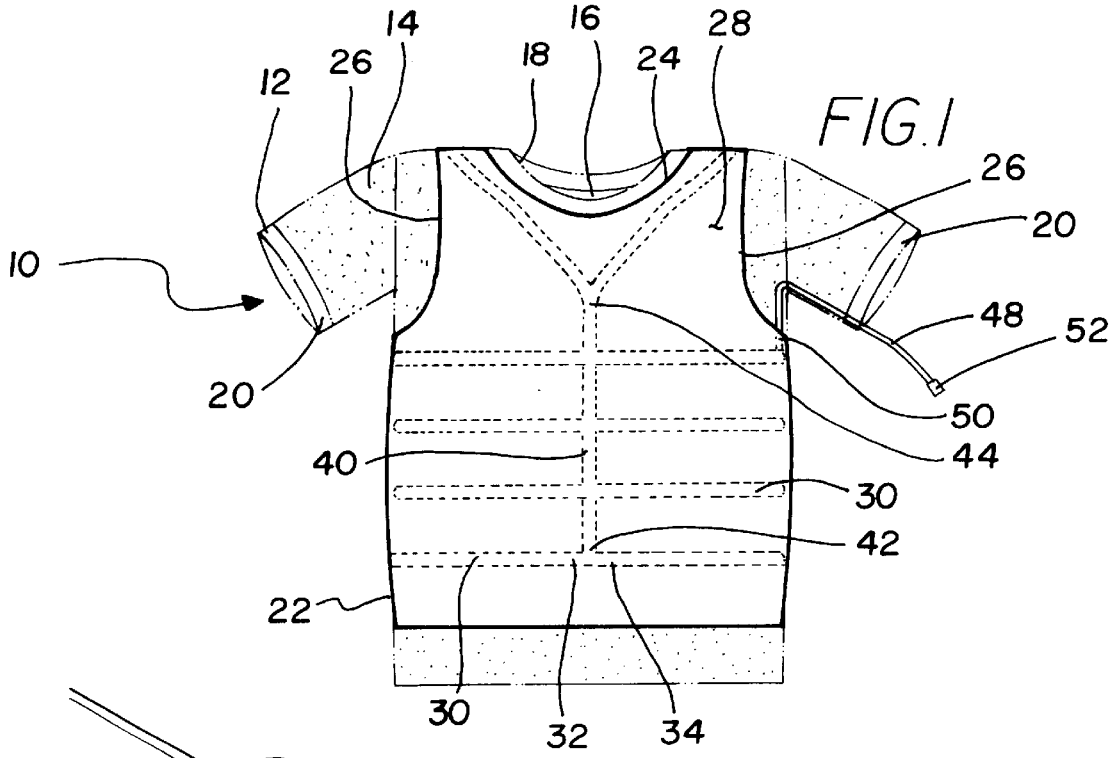
FIG. 1 is a schematic front view of a new portable cooling device according to the present invention.
Figure 2:
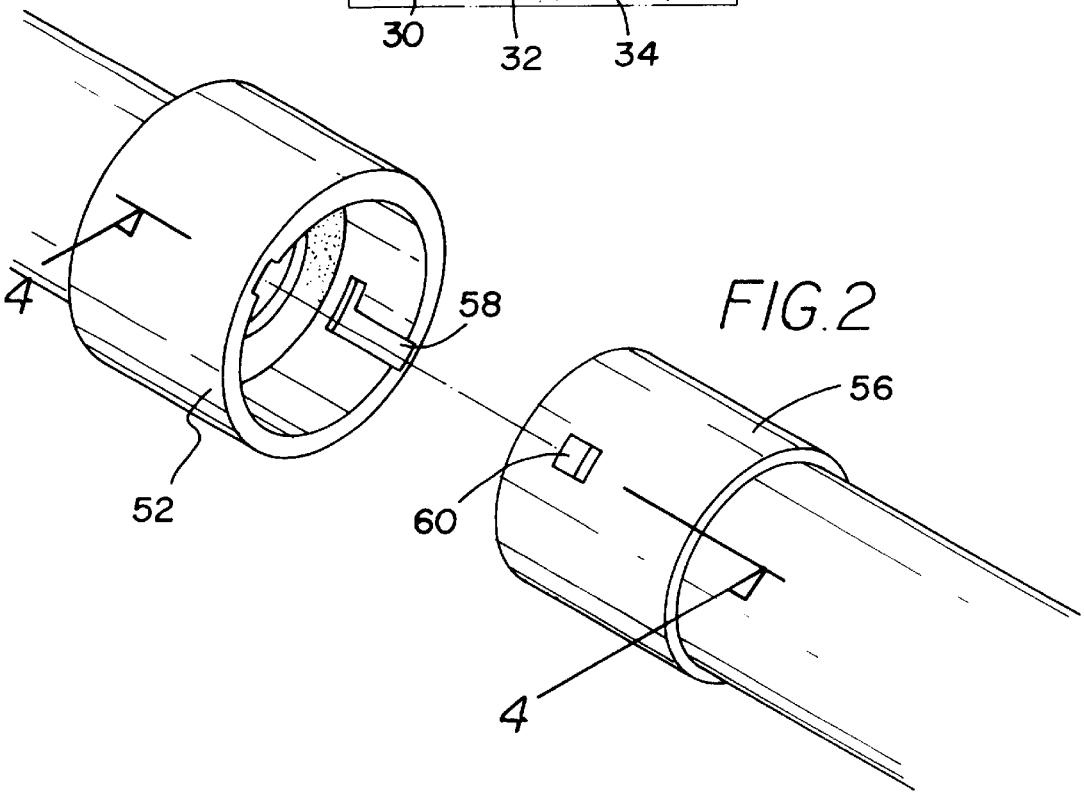
FIG. 2 is a schematic perspective view of the supply tube connector of the present invention.
Figure 3:
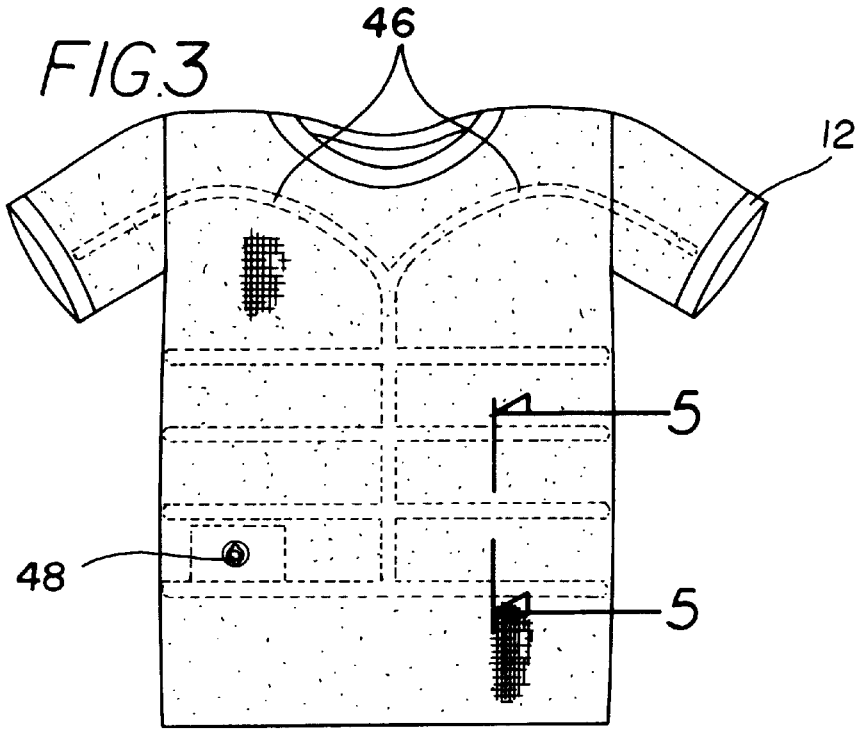
FIG. 3 is a schematic front view of the second embodiment f the shirt portion of the present invention.
Figure 4:
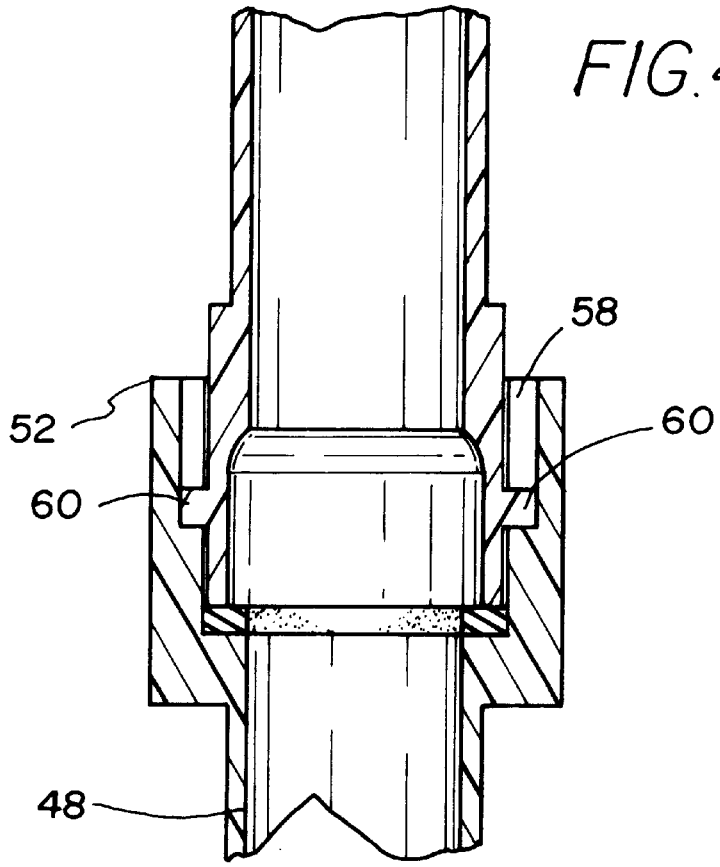
FIG. 4 is a schematic cross-sectional view taken along line 4—4 of the present invention.
Figure 7:
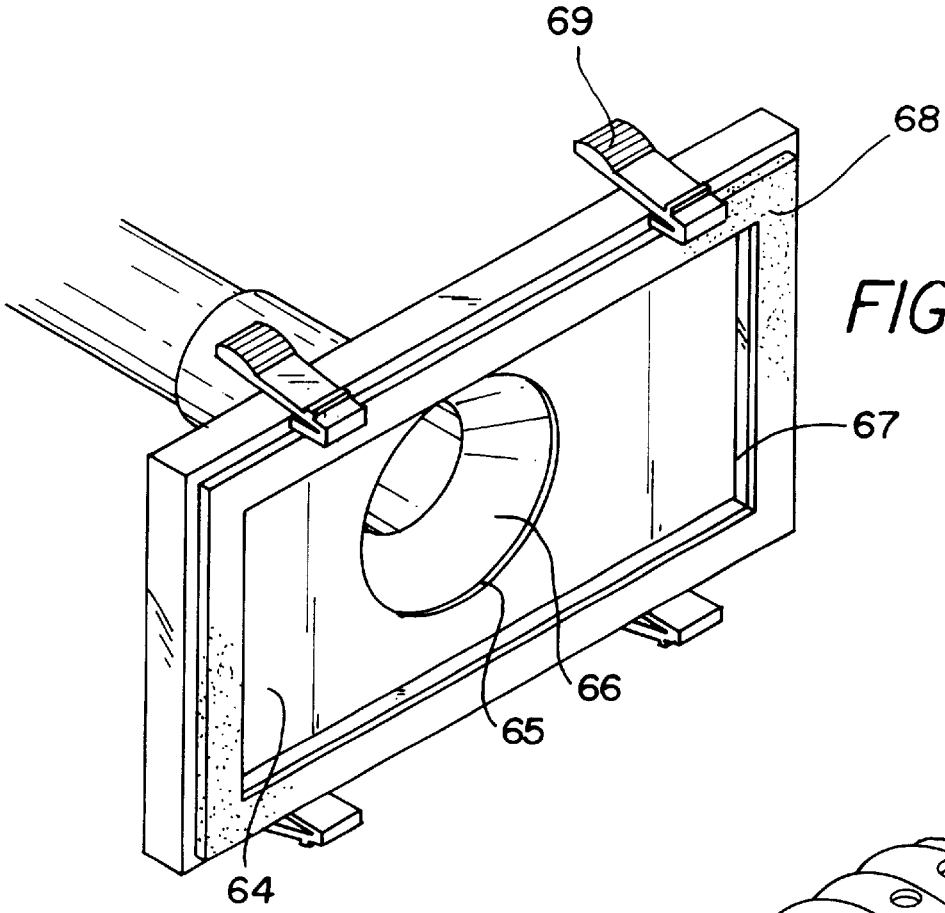
FIG. 7 is a schematic perspective view of the second embodiment of the air supplying means of the present invention.
Figure 8:
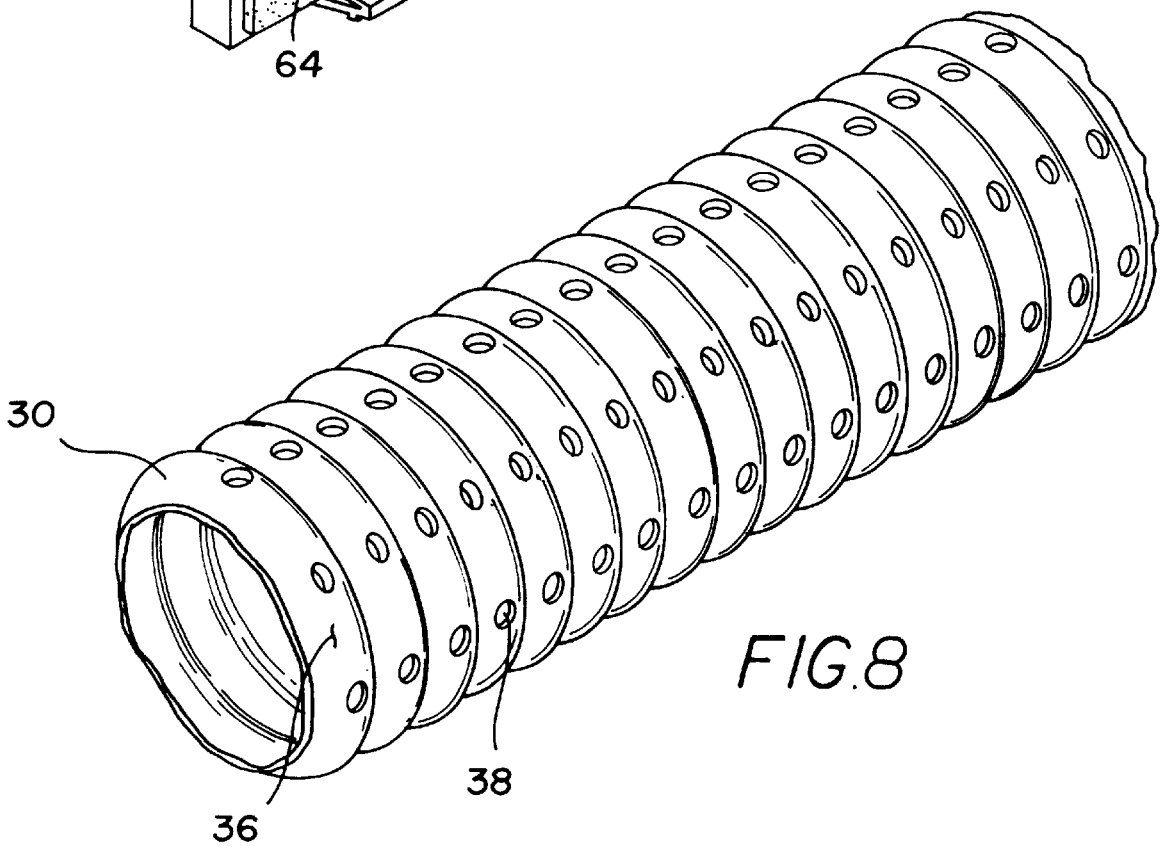
FIG. 8 is a schematic perspective view of a representative tubular member of the present invention.

With reference now to the drawings, and in particular to FIGS. 1 through 8 thereof, a new portable cooling device embodying the principles and concepts of the present invention and generally designated by the reference numeral 10 will be described.

As best illustrated in FIGS. 1 through 8, the portable cooling device 10 generally comprises a shirt portion 12. The shirt portion 12 comprises a front panel 14 and a back panel 16 securely coupled together. The shirt portion 12 has a neck opening 18 and a pair of sleeves 20. The shirt portion 12 is adapted for removably coupling a torso. Each of the panels 14, 16 preferably comprises a perforated cloth material. The shirt portion 12 is generally a conventional T-shirt having a plurality of apertures therein for better airflow.

A vest portion 22 is adapted for removable placement over the shirt portion 12. The vest portion 22 has a neck opening 24 therein. The vest portion 22 has a pair of side openings 26 therein each adapted to receive one of the sleeves 20. The vest portion 22 has an inner surface, not shown, and an outer surface 28.

A cooling system includes a plurality of tubular members 30. Each of the tubular members 30 is elongate and has a first end 32 and a second end 34. Each of the tubular members 30 is securely attached to the inner surface of the vest portion 22. Each of the tubular members 30 extends around an inner diameter of the vest portion such that the first 32 and second ends 34 of the tubular members 30 are positioned along a line extending through a sternum portion of the vest portion 22. Each of the tubular members 30 has a peripheral wall 36 having a plurality of openings 38 therein. The peripheral wall Is preferably has a rounded, corrugated surface. Each of the tubular members 30 comprises a generally resiliently flexible material preferably being a plastic.

A connector tube 40 has a first end 42 and a second end 44. The connector tube 40 is securely attached to the inner surface of the vest member 22 and extends between the first 32 and second 34 ends of the tubular members 30. Each of the first 32 and second 34 ends of the tubular members 30 is fluidly coupled to the connector tube 40. The connector tube 40 comprises a resiliently flexible material. A pair of extension tubes 46 each has an end fluidly coupled to the second end 44 of the connector tube 40. The extension tubes extend over the shoulders of the user or through the sleeves. The extension tubes 46 each have at plurality of openings therein an resemble the tubular members 30.

A supply tube 48 supplies air to the tubular members. The supply tube 48 has a first end 50 and a second end 52. The first end 50 is fluidly coupled to one of the tubular members 30. The supply tube 48 comprises a resiliently flexible member.

An air delivery means delivers air to the supply tube. The air delivery means preferably comprises an air pump device 54. The air Pump device 54 has an exit conduit 56 thereon. The air pump device 54 is adapted to pump air into the exit conduit 56. The exit conduit 56 is removably attachable to the second end 52 of the supply tube 48. The second end 52 of the supply tube has an inside surface having a pair of opposed L-shaped channels 58 therein. The exit conduit 56 is tubular and has a pair of oppositely extending nubs 60 on its surface. The exit conduit 56 may be extended in to the second end 52 of the supply tube 48 such that each of the nibs 60 may releasably engage one of the channels 58.

A power supply 62 for supplies power to the air pump device 54. The power supply 62 is operationally coupled to the air pump device 54. The power supply 62 preferably comprises a conventional a plug adapted for plugging into an automobile, though batteries may also be used.

In the second embodiment, an air conditioning vent, not shown, is used to supply air. The second embodiment includes a panel 64 having a hole 65 therethrough. An edge of the hole 65 has a lip 66 thereon. The panel 64 has a peripheral edge 66 having a flange 67 thereon. The flange 67 extends in an opposite direction of the lip 66. The fiance 67 has an elastomeric coating thereon 68. The second end 52 of the supply tube 48 is removably attachable to the lip 66. The panel 64 may be positioned over an air conditioning vent such that vent from the air conditioning vent may travel into the supply tube 48.

In another embodiment, the vest portion is not used and the tubular members 30 and the connector tube 40 are attached to the inner surface 70 of the front 14 and back 16 panels. Preferably, the shirt portion 12 has a pair of inner panels 72. Each of the inner panels 72 being, securely coupled to one of the front 14 and back 16 panels such that the tubular members 30 and the connector tube 40 are positioned between the inner panels 72 and the front 14 and back 16 panels. Ideally, the openings 38 in the tubular members 30 are directed toward the inner panels 72. The inner panels 72 are also preferably perforated.

In use, the shirt portion 12 is placed over the torso of a user. If the tubular members 30 are in the vest portion 22, then the vest portion 22 is placed over the shirt portion 12. The device 10 is worn under outer garments, such as a police uniform. The user may couple the air pump device 54 to the supply tube 48, or may place the plate 64 over the vent of a car air conditioner or other air conditioner. The plate 64 preferably has clips 69 thereon for removable attachment to the vent.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable cooling device, said device being removably wearable by a person, said device comprising:

a shirt portion, said shirt portion comprising a front panel and a back panel securely coupled together, said shirt portion having a neck opening and a pair of sleeves, each of said panels having an inner and outer surface;

a cooling system, said cooling system comprising;

a plurality of tubular members, each of said tubular members being elongate and having a first end and a second end, each of said tubular members being securely attached to said inner surface of said shirt portion, each of said tubular members having a peripheral wall having a plurality of openings therein;

a connector tube, said connector tube having a first end and a second end, said connector tube being securely attached to said inner surface of said vest member, each of said first and second ends of said tubular members being fluidly coupled to said connector tube;

a supply tube for supplying air to said tubular members, said supply tube having a first end and a second end, said first end fluidly coupled to one of said tubular members; and an air delivery means for delivering air to said supply tube.

2. The portable cooling device as in claim 1, wherein said shirt portion further comprises:

a pair of inner panels, each of said inner panels being securely coupled to one of said front and back panels such that said tubular members and said connector tube are positioned between said inner panels and said front and back panels, wherein said openings in said tubular members are directed toward said inner panels.

3. The portable cooling device as in claim 2, wherein said shirt portion further comprises:

each of said panels comprising a perforated cloth material such that there is relatively little resistance to air flow through said panels.

4. The portable cooling device as in claim 1, wherein said plurality of tubular members further comprises:

each of said tubular members extending around an inner diameter of said vest portion such that said first and second ends of said tubular members are positioned along a line extending through a sternum portion of said shirt portion, each of said tubular members comprising a generally resiliently flexible material.

5. The portable cooling device as in claim 2, wherein said air delivery means comprises:

a panel, said panel having a hole therethrough, an edge of said hole having a lip thereon, said panel having a peripheral edge having a flange thereon, said flange extending in an opposite direction of said lip, said flange having an elastomeric coating thereon, said second end of said supply tube being removably attachable to said lip, wherein said panel may be positioned over an air conditioning vent such that vent from said air conditioning vent may travel into said supply tube.

6. The portable cooling device as in claim 2, wherein said air delivery means comprises:

an air pump device, said air pump device having an exit conduit thereon, said air pump device being adapted to pump air into said exit conduit, said exit conduit being removably attached to said second end of said supply tube; and a power supply for supplying power to said air pump device, said power supply being operationally coupled to said air pump device.

7. A portable cooling device, said device being removably wearable by a person, said device comprising:

a shirt portion, said shirt portion comprising a front panel and a back panel securely coupled together, said shirt portion having a neck opening and a pair of sleeves, said shirt portion being adapted for removably coupling a torso, each of said panels comprising a perforated cloth material;

a vest portion, said vest portion being adapted for removable placement over said shirt portion, said vest portion having a neck opening therein, said vest portion having a pair of side openings therein each adapted to receive one of said sleeves, said vest portion having an inner surface and an outer surface;

a cooling system, said cooling system comprising;

a plurality of tubular members, each of said tubular members being elongate and having a first end and a second end, each of said tubular members being securely attached to said inner surface of said vest portion, each of said tubular members extending around an inner diameter of said vest portion such that said first and second ends of said tubular members are positioned along a line extending through a sternum portion of said vest portion, each of said tubular members having a plurality of openings therein, each of said tubular members comprising a generally resiliently flexible material;

a connector tube, said connector tube having a first end and a second end, said connector tube being securely attached to said inner surface of said vest member and extending between said first and second ends of said tubular members, each of said first and second ends of said tubular members being fluidly coupled to said connector tube, said connector tube comprising a resiliently flexible material;

a supply tube for Supplying air to said tubular members, said supply tube having a first end and a second end, said first end fluidly coupled to one of said tubular members, said supply tube comprising a resiliently flexible member;

an air delivery means for delivering air to said supply tube, said air delivery means comprising;

an air pump device, said air pump device having an exit conduit thereon, said air pump device being adapted to pump air into said exit conduit, said exit conduit being removably attached to said second end of said supply tube; and a power supply for supplying power to said air pump device, said power supply being operationally coupled to said air pump device, said power supply comprising a plug adapted for plugging into an automobile.

* * * * *